US005466340A

United States Patent [19]

Begemann et al.

[11] Patent Number: 5,466,340

[45] Date of Patent: Nov. 14, 1995

[54] PAPER MACHINE HEADBOX AND METHOD OF CONTROLLING PULP MATERIAL PARAMETERS

[75] Inventors: Ulrich Begemann, Leonberg; Helmut Heinzmann, Böhmenkirch; Wolfgang Ruf, Heidenheim, all of Germany

[73] Assignee: J. M. Voith GmbH, Heidenheim, Germany

[21] Appl. No.: 240,878

[22] Filed: May 11, 1994

[30] Foreign Application Priority Data

May 13, 1993 [DE] Germany ..... 43 16 054.9

[51] Int. Cl.[6] ..... D21F 1/02

[52] U.S. Cl. ..... 162/216; 162/343; 162/336

[58] Field of Search ..... 162/381, 380, 162/343, 336, 123, 125, 129, 212, 216

[56] References Cited

U.S. PATENT DOCUMENTS

| | | | |
|---|---|---|---|
| 1,965,579 | 7/1934 | Dennett | 162/381 |
| 2,931,503 | 4/1960 | Clark | 162/380 |
| 3,271,241 | 9/1966 | Mummé | 162/380 |
| 4,954,249 | 9/1990 | Gero et al. | 209/273 |

FOREIGN PATENT DOCUMENTS

| | | |
|---|---|---|
| 4019593A1 | 1/1992 | Germany . |
| 4234940A1 | 2/1993 | Germany . |

*Primary Examiner*—W. Gary Jones
*Assistant Examiner*—Calvin Padgett
*Attorney, Agent, or Firm*—Marshall, O'Toole, Gerstein, Murray & Borun

[57] ABSTRACT

A paper machine headbox having divided sections for feeding pulp suspensions with different properties therethrough includes a single inlet line and a plurality of feed lines connected thereto. In at least one of the feed lines, there is a separation device which separates certain pulp suspension components from the pulp suspension flowing therethrough. A discharge line connected to the separation device conveys separated pulp suspension components therefrom. A continuing feed line connected to the separation device conveys the remaining pulp suspension to the headbox.

16 Claims, 5 Drawing Sheets

PAPER MACHINE HEADBOX AND METHOD OF CONTROLLING PULP MATERIAL PARAMETERS

BACKGROUND OF THE INVENTION

1. Field of the Invention

The invention relates to apparatus and methods for controlling process and material parameters of pulp in a paper making machine and in particular to pulp flowing into a paper machine headbox.

2. Description of Related Technology

A headbox of a paper machine may be divided into sections by walls spaced across the width of the machine in order to allow for independent control in each section of various properties of the paper pulp suspension, such as pulp density and fiber orientation.

Such a sectioned headbox for a paper making machine is disclosed in DE 40 19 593. In such a device, a plurality of pulp feeds are fed to a headbox which has a forming unit divided into sections over a width thereof. The properties of the pulp suspension in the individual feed lines or channels can be influenced by mixing two pulp suspension streams of different properties and different throughputs.

A disadvantage of the headbox disclosed in DE 40 19 593 is that it requires two ready reserves of a pulp suspension, each reserve of substantially constant composition. Another disadvantage is that when the pulp suspension properties of a section are adjusted for the purpose of influencing a single given suspension property, other properties of the pulp suspension typically change in the same ratio.

SUMMARY OF THE INVENTION

It is an object of the invention to overcome one or more of the problems described above. It is also an object of the invention to provide a sectioned headbox which is: (1) capable of influencing the properties of a pulp suspension in divided sections thereof while requiring only a single common pulp suspension supply; and (2) capable of influencing several different pulp suspension properties independently of one another, section by section.

A headbox according to the invention has divided sections for feeding pulp suspensions with different properties therethrough. The headbox includes an inlet line and a plurality of feed lines connected thereto. At least one of said feed lines has a separation device connected thereto. The separation device selectively separates certain pulp suspension components from the pulp suspension flowing therethrough. Connected to the separation device are a discharge line for the separated pulp suspension components and a continuing feed line for the remaining pulp suspension.

In a method according to the invention parameters of a fiber web such as fiber mass, ash and moisture are influenced by providing a headbox with sections and performing at least one separation of selected components of a pulp suspension stream with respect to each section.

Other objects and advantages of the invention will be apparent to those skilled in the art from the following detailed description taken in conjunction with the drawings and the appended claims.

DETAILED DESCRIPTION OF THE INVENTION

In a headbox according to the invention, the headbox is fed from a common source or container whereby the feeds between the container and the headbox are divided into individual feed lines or conduits. In each individual feed line, one or several separation devices, known for example from EP 422,069, are provided. In each separation device, certain pulp suspension properties, for example, fiber mass, ash, and/or fiber length profile, can be selectively influenced by separating certain components from the pulp suspension flowing through the individual line.

FIGS. 1 through 5 show five embodiments of a headbox according to the invention. Each headbox includes a forming unit F divided into sections $S_1$ through $S_n$ along a width of the headbox. With respect to the direction of pulp flow through the paper machine, each section $S_1$–$S_n$ has a settling chamber B followed by a subsequent turbulent section Tu and then a nozzle D. With respect to each embodiment of the invention shown in FIGS. 1–5, a single pulp suspension source for the headbox is represented by an inlet line or storage container V.

Figure 1:
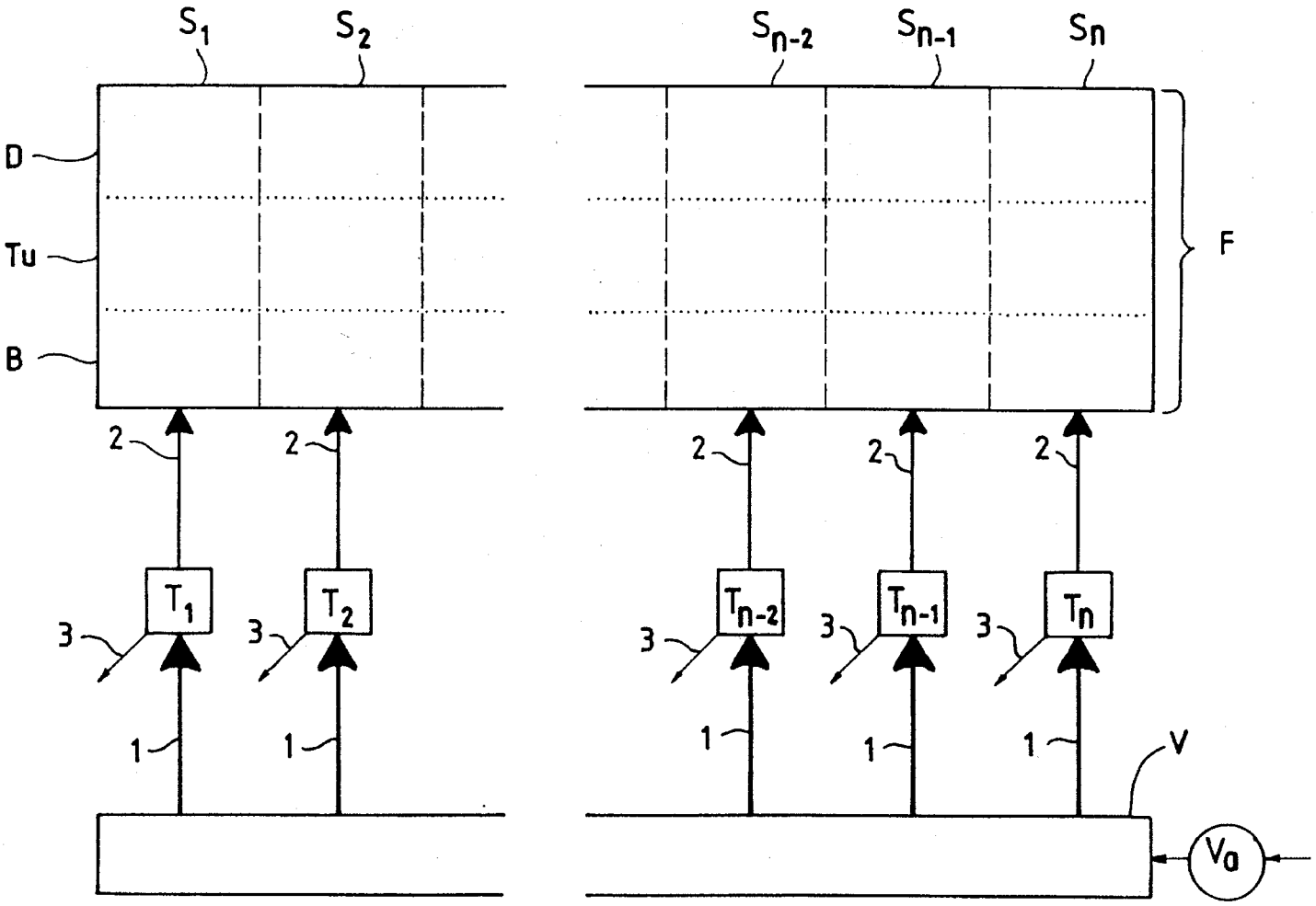
FIG. 1 is a schematic view of a headbox according to the invention showing a separation device cooperating with each headbox section.

With reference to FIG. 1, according to the invention, pulp from the inlet line or storage container V is fed through lines 1 to a number of separation devices $T_1$ through $T_n$. The flow of pulp into the inlet V is controlled by a valve $V_a$. Each line 1 is connected to the storage container V and to one separation device. In the separation devices $T_1$–$T_n$, selected components of a pulp suspension are separated and removed through a line 3 connected to the separation device. The remaining suspension stream flows through a line 2 which is connected to the separation device and also to one section $S_1$–$S_n$ of the forming unit F.

The separation devices $T_1$–$T_n$ are independently selectively controlled in a known manner. The separation devices may be, for example, sifters, hydrocyclones or centrifugal separators.

FIG. 1 illustrates an embodiment of the invention in which the amount of pulp suspension flowing, for example, through the feed line 1, the separator $T_1$, and the feed line 2 and into the section $S_1$ (i.e. the flow rate of the pulp through lines 1 and 2) is not individually controlled in the lines 1 and 2 and depends upon the flow rate of the pulp fed into the inlet V.

Figure 2:
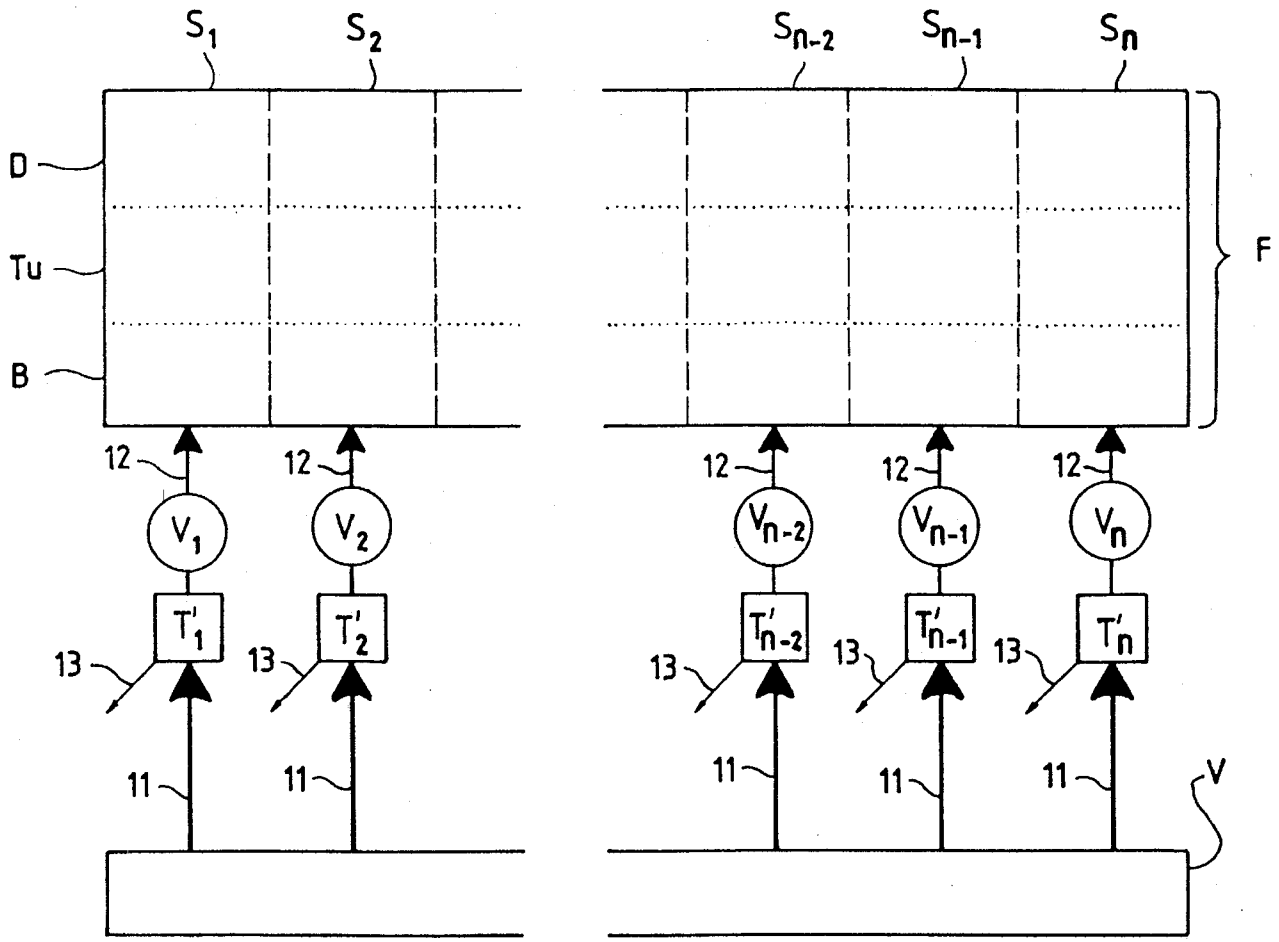
FIG. 2 is a schematic view of a second embodiment of a headbox according to the invention showing valves cooperating with each headbox section.

FIG. 2 shows an embodiment of a headbox according to the invention similar to the embodiment shown in FIG. 1 with the elements identified by the reference characters 11, 12, 13, and $T'_1$ through $T'_n$ being substantially identical in function to the elements 1, 2, 3, $T_1$ through $T_n$, respectively, described with respect to FIG. 1. FIG. 2 also shows control valves $V_1$ through $V_n$ disposed in each line 12 so that the flow of pulp through each line 12 into a respective section of the forming unit F may be independently controlled. Also according to the invention, valves (not shown) can be placed into the feed lines 11.

Figure 3:
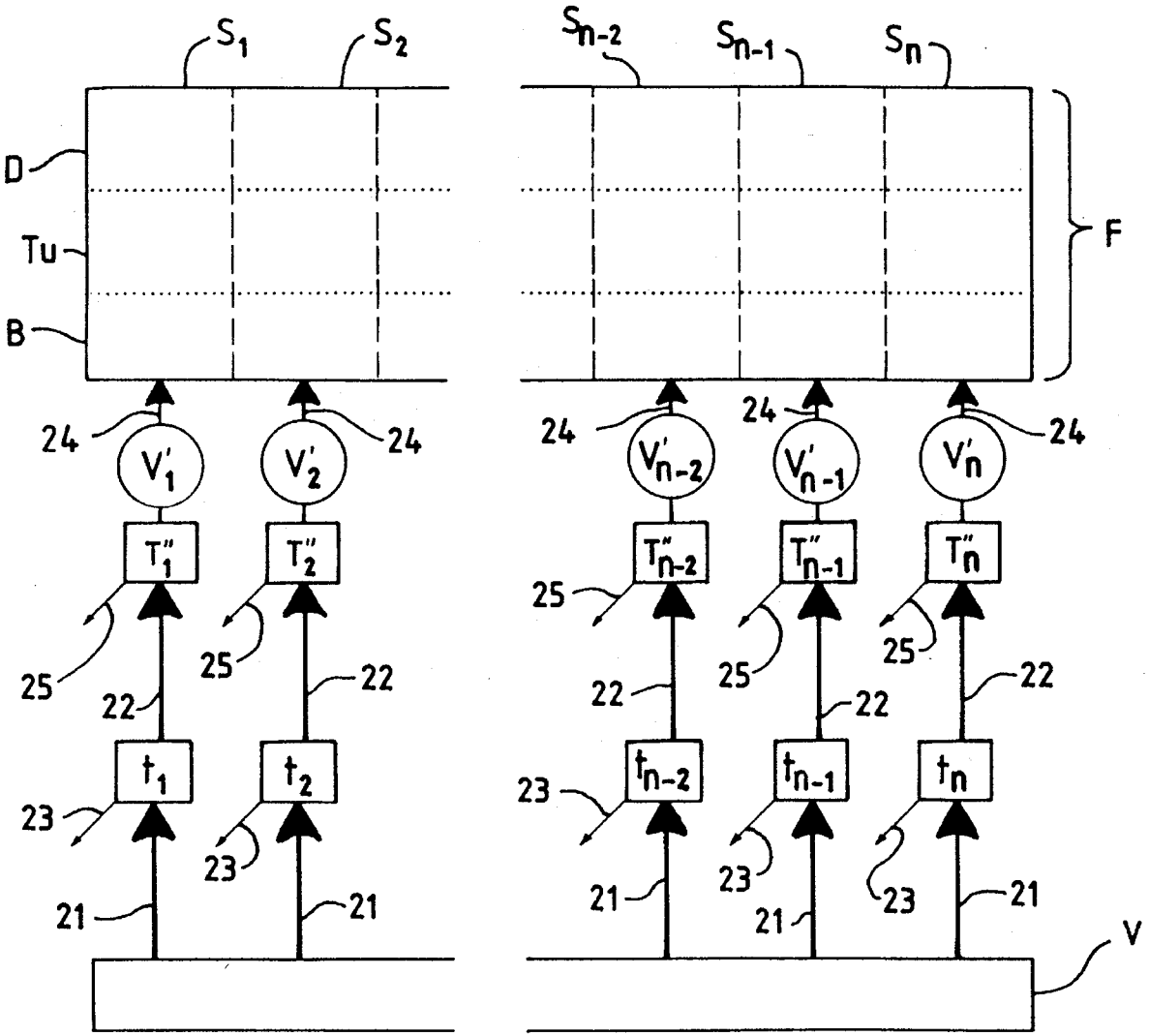
FIG. 3 is a schematic view of a third embodiment of a headbox according to the invention showing two separation devices per section being connected in series.

FIG. 3 shows an embodiment of a headbox according to the invention similar to the embodiments shown in FIGS. 1 and 2 with the elements identified by the reference characters 21, 22, 23, and $t_l$ through $t_n$ being substantially identical in function to the elements 1, 2, 3, and $T_l$ through $T_n$, respectively, described with respect to FIG. 1. Additionally, each feed line 22 is connected to a second separation device $T''_l$ through $T''_n$. Lines 24 connect each of the second separation devices to a section of the forming device and include valves $V'_l$ through $V'_n$ for individual control of the flow of a pulp suspension through each line 24. Thus, a suspension stream from the storage container V is first fed, for example, to the separation device $t_l$ which separates components from the pulp suspension which are dispensed through the line 23. The remaining suspension is fed into the line 22 and then into the second separation device $T''_l$ which separates components from the suspension which are removed through a line 25. The remaining pulp suspension is fed through the line 24 and the valve $V'_l$ to the corresponding section $S_l$ of the forming unit F.

Figure 4:
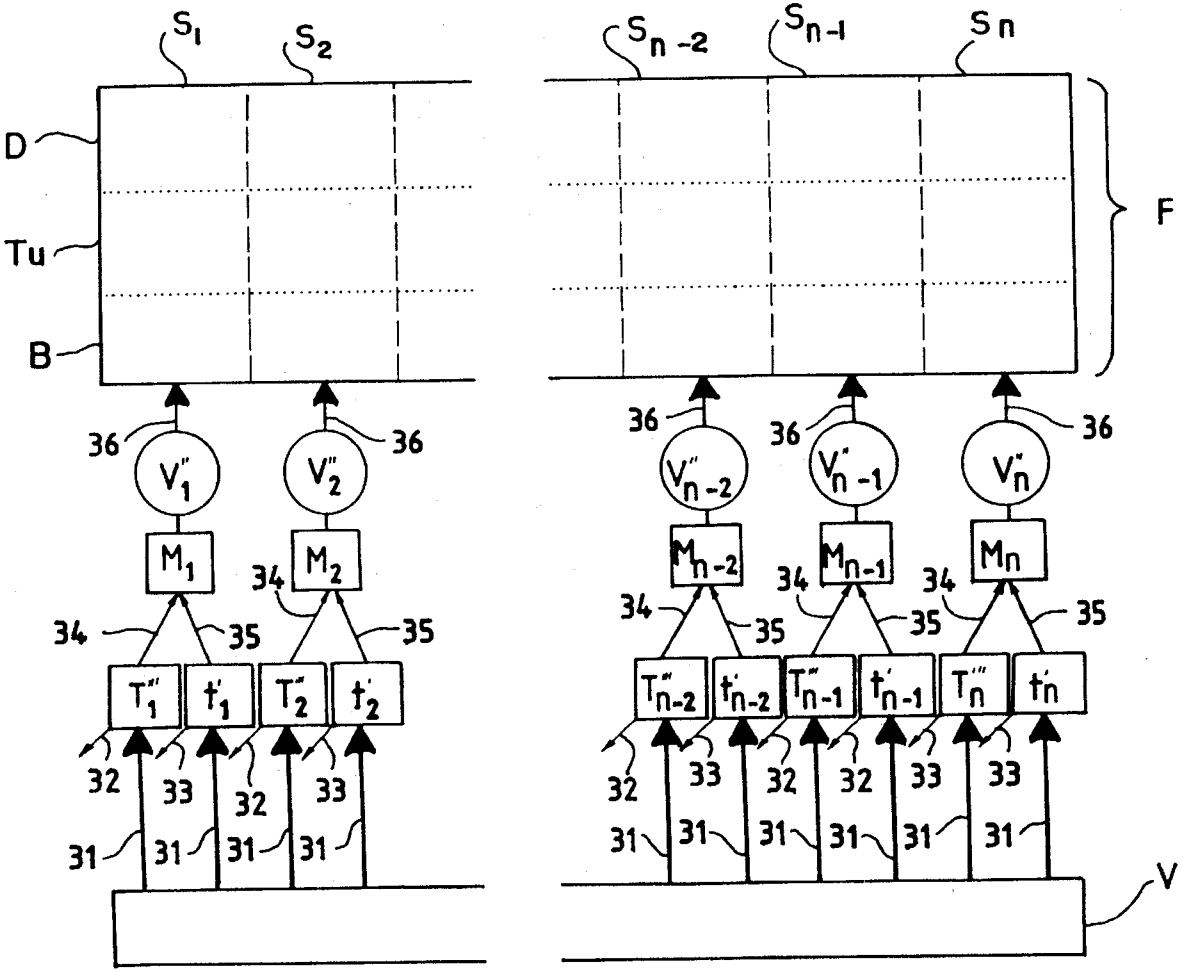
FIG. 4 is a schematic view of a fourth embodiment of a headbox according to the invention showing two separation devices per section being connected in parallel.

FIG. 4 shows an embodiment of a headbox according to the invention having two separation devices cooperating with each pulp feed similar to the embodiment shown in FIG. 3, with the exception that the separation devices are connected in parallel rather than in series (as shown in FIG. 3). A pulp suspension flowing from the inlet line or storage container V is fed through lines 31 to pairs of separation devices $T'''_l$ through $T'''_n$ and $t'_l$ through $t'_n$. For example, pulp suspension streams from two lines 31 are respectively separated in separation devices $T_l$ and $t_l$ resulting in a suspension stream which is removed from the device $T_l$ through a line 32 and another stream removed from the device $t_l$ through a line 33. The suspension streams flowing through the line 32 and 33 may not contain certain desired substances of the remaining suspension streams flowing out of the separators into the lines 34 and 35, respectively, or may contain such substances at a lower concentration. The separation devices $T_l$–$T_n$ and $t_l$–$t_n$ can also filter out different substances. The main suspension streams flowing through the lines 34 and 35 are then fed to mixers $M_l$–$M_n$ cooperating with each pair of lines 34 and 35 from the different separation devices. The individual streams 34 and 35 are mixed in a mixer and then fed through a line 36 to a corresponding section of the forming unit F. The pulp suspension flows through the lines 36 are regulated by valves $V''_l$–$V''_n$ connected thereto.

According to the invention, it is also possible to use combinations of separation devices connected in parallel and in series. For example, the separation devices can be connected in series with respect to certain sections of the forming device F and in parallel with respect to other forming device sections. With respect to selected forming device sections, the separation devices can be omitted. Furthermore, several feed lines may feed into an individual forming device section, or, one feed line may supply a pulp suspension from one separation device to several forming device sections.

Figure 5:
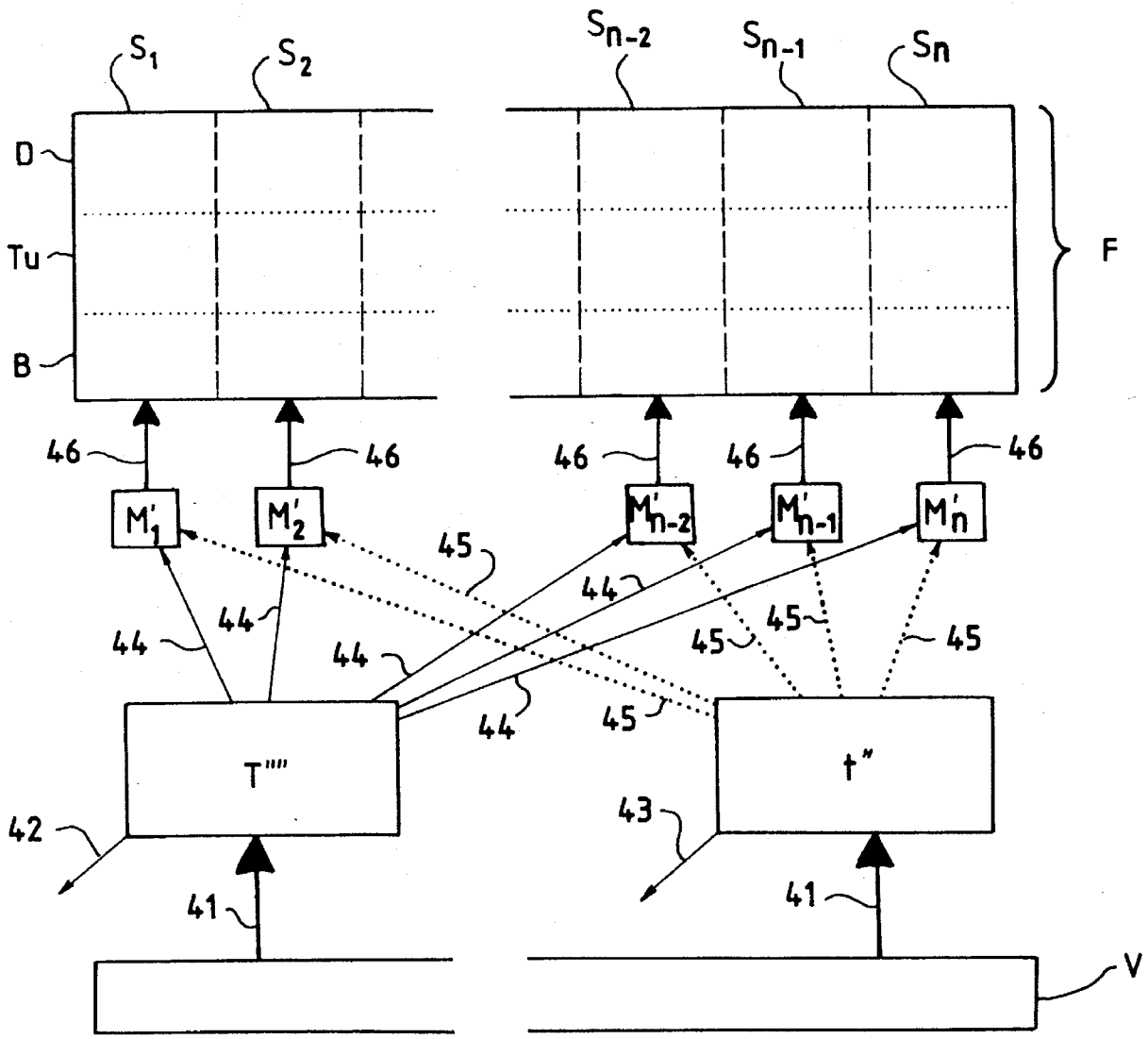
FIG. 5 is a schematic view of a fifth embodiment of a headbox according to the invention.

FIG. 5 shows an embodiment of a headbox according to the invention in which a pulp suspension from the inlet line or storage container V is fed through lines 41 to one of two separation devices T'''' and t'', whereby the separation devices T'''' and t'' discharge a separated pulp suspensions through lines 42 and 43, respectively. Pulp suspension streams are selectively fed through lines 44 and 45 connected to devices T'''' and t'', respectively, to mixing chambers $M'_l$–$M'_n$, each of which is connected to an individual section of the forming unit F. Thus, pulp suspension streams from both of the separators T'''' and t'' are mixed in a selected mixer and then fed to cooperating sections $S_l$–$S_n$ through lines 46.

Control valves (not shown) can be incorporated into the lines 41–46 in order to obtain the desired composition ratio of the pulp suspension streams and the desired flow rates of the streams. Throughput of a pulp suspension into the headbox may be controlled by individually controlling the amount of pulp flowing through each feed line connected to a forming unit section or with respect to the total amount of the pulp suspension entering a forming unit section. The mixers $M_l$–$M_n$ may be eliminated and the pulp from lines 44 and 45 may be fed directly from the separation devices into the forming device.

The foregoing detailed description is given for clearness of understanding only, and no unnecessary limitations should be understood therefrom, as modifications within the scope of the invention will be apparent to those skilled in the art.

We claim:

1. In a paper machine having a headbox with a plurality of divided sections for feeding pulp suspensions with different properties through said sections, the improvement comprising:

(a) an inlet line for directing the flow of a pulp suspension therethrough;

(b) a plurality of feed lines connected to the inlet line;

(c) at least one separation device connected to each feed line for selectively separating certain pulp suspension components from the pulp suspension flowing from the feed line and through the separation device;

(d) a discharge line connected to each separation device for conveying separated pulp suspension components from said separation device; and (e) at least one continuing feed line connected to each separation device, said continuing feed line connected to a particular section of the headbox for conveying remaining pulp suspension from the separation device into said headbox section.

2. The improvement of claim 1 wherein at least one feed line has at least two separation devices connected thereto in series.

3. The improvement of claim 1 wherein at least two separation devices are connected in parallel to at least one feed line.

4. The improvement of claim 1 further comprising means for controlling the amount of pulp flowing into a feed line, said controlling means disposed in the inlet line.

5. The improvement of claim 1 further comprising means for independently controlling the amount of pulp suspension flowing through each feed line.

6. The improvement of claim 1 further comprising means for independently controlling each separation device.

7. The improvement of claim 1 wherein the separation device is at least one of a sifter, a hydrocyclone, and a centrifugal separator.

8. The improvement of claim 1 wherein at least one separation device is connected to more than one headbox section.

9. The improvement of claim 1 wherein at least one headbox section is connected to more than one separation device.

10. A paper machine comprising a headbox having a forming unit divided into sections across the machine-width, a storage container for pulp suspension, and means for feeding pulp between the storage container and the forming unit, said pulp feeding means including at least two separation devices disposed between the storage container and the forming unit, and connecting lines disposed between each separation device and selected sections of the forming unit.

11. The headbox of claim 10 further comprising a mixer connected between the separation devices and the forming units for mixing partial streams of pulp from the separation devices to form a total stream, and a total stream line for feeding the total stream into selected sections of the forming unit.

12. A paper machine comprising a headbox having a sectioned forming unit across the machine-width, a storage container, and means for feeding pulp between the storage container and the forming unit, said pulp feeding means having at least one separation device, at least two discharge flow lines connected to the separation device and the forming unit, each discharge line for directing flow of a partial pulp stream from the separation device to the forming unit, a feed line connected to each section of the forming unit for each partial stream from the separation device, and means for controlling throughput of pulp into the headbox.

13. The headbox of claim 12 wherein the throughput controlling means is adapted to control throughput as a ratio of throughput to the amount of pulp flowing through a feed line of a partial pulp stream.

14. The headbox of claim 12, wherein the throughput controlling means is adapted to control throughput as a ratio of throughput to the amount of pulp entering a forming unit section.

15. The headbox of claim 12 further comprising mixers inserted between the separation device and each forming unit section.

16. A method of influencing parameters of a fiber web, including the parameters of fiber mass, ash, and moisture, the method comprising providing a headbox with a plurality of sections across the machine-width and performing at least one separation of selected components of a pulp suspension stream flowing into each section.

* * * * *